United States Patent [19]

Moore

[11] Patent Number: 4,565,133

[45] Date of Patent: Jan. 21, 1986

[54] CLAMP ARRANGEMENT FOR TRACK LIFTING AND ALIGNING DEVICE

[75] Inventor: Roy J. Moore, Columbia, S.C.

[73] Assignee: Canron Corp., West Columbia, S.C.

[21] Appl. No.: 492,876

[22] Filed: May 9, 1983

[51] Int. Cl.[4] ..... E01B 27/17

[52] U.S. Cl. ..... 104/7 B

[58] Field of Search ..... 104/7 R, 7 B, 8, 12

[56] References Cited

U.S. PATENT DOCUMENTS

| | | | |
|---|---|---|---|
| Re. 29,437 | 10/1977 | Hurni | 104/7 B |
| 3,968,752 | 7/1976 | Theurer | 104/7 B |
| 4,111,128 | 9/1978 | Keyes | 104/7 B |
| 4,342,263 | 8/1982 | Hurni | 104/7 B |

FOREIGN PATENT DOCUMENTS

| | | | |
|---|---|---|---|
| 624625 | 8/1981 | Switzerland | 104/8 |

*Primary Examiner*—Randolph A. Reese

*Attorney, Agent, or Firm*—Wenderoth, Lind & Ponack

[57] ABSTRACT

A railroad track lifting and aligning device mounted for track travel on a longitudinally extending main frame of a track working machine and having a track aligning sub-frame extending transversely of the main frame. Wheels on the sub-frame engage the rails of the track, and rail contacts on the sub-frame engage the inside of each of the rails of the track. A track lifting rail hook guide member is provided for each of the rails of the track mounted for vertical movement on and relative to the sub-frame at each end thereof on vertically extending guide-rods on the sub-frame. A rail hook for externally engaging a rail of the track is provided in each of the guide members, and an apparatus for adjusting the position of a rail hook in its guide member, longitudinally of the sub-frame is provided. Track aligning jacks are mounted on the device for moving the sub-frame laterally of the main frame, and track lifting jacks are connected to each of the guide members to move each member, with its hook, vertically of the sub-frame along the guide-rods to adjust the vertical position of the hook relative to the sub-frame and to lift said track vertically.

9 Claims, 2 Drawing Figures

CLAMP ARRANGEMENT FOR TRACK LIFTING AND ALIGNING DEVICE

BACKGROUND OF THE INVENTION

The present invention relates to railroad track lifting and aligning clamping devices of the type that are provided on railroad tamping machines, primarily upon machines which can work on tangent track and in switches.

Examples of the type of device to which the present invention relates are seen in U.S. Pat. No. 4,111,128; British Pat. No. 1,416,693; British Pat. No. 1,493,153 (corresponding to U.S. Pat. No. 3,968,752); French Patent application No. 81 08595 (publication no. 2,483,481); United Kingdom patent application GB No. 2035423A (corresponding to U.S. Pat. No. 4,323,013 and French No. 79 26767 publication no. 2442914). Examples of other devices of interest to this general art are seen in British patent nos. 1,264,057; 1,540,199; U.S. Pat. No. 3,690,263 and Swiss Pat. no. 624,625.

Generally speaking the devices of the prior art have been complex in the nature in which the rail lifting hooks can be adjusted to accommodate for changes in rail height and lateral position. Such changes may be brought about by lateral displacement in switches, or in rail height because of rail head wear. Also changes of cross-section at rail joints represent changes of rail configuration. Sometimes also it is desired to grasp under the base of the rail rather than the rail head. Although efforts have been made to simplify the construction of the prior art devices, a great many of them still have defects. For example in certain types, if the rail engaging hooks slip in a "production" lifting mode the whole lifting and aligning frame is pulled clear of the track. In other words, a positive lock of the lining clamp has been difficult to achieve under the great variety of rail cross-sections encountered during work on tangent track, jointed track and track in the area of switches. Time then has to be spent readjusting the frame into position before rapid production can continue. This type of disengagement is common also when working on worn rail, or when working on two different rail sizes, or in switches. Lining contact is frequently lost and when the lining force is applied either the rail is not lined or the lining devices may be damaged.

Applicant seeks to simplify the construction of a rail clamp which can operate satisfactorily in a production, or in a switch correcting, mode, which is simple to maintain and relatively cheap to manufacture and which is positive in its gripping and force transmitting qualities.

SUMMARY OF THE INVENTION

According to the present invention there is provided a railroad track lifting and aligning device mounted for track travel on a longitudinally extending main frame of a track working machine and comprising a track aligning sub-frame extending transversely of the main frame; wheels on the subframe for engaging the rails of the track; rail contacting means on the sub-frame for engaging the inside of each of the rails of the track; a track lifting rail hook guide member for each of the rails of the track mounted for vertical movement on the sub-frame at each end thereof; a rail hook, for externally engaging a rail of the track, in each of the guide members; means for adjusting the position of a rail hook in its guide member, longitudinally of the sub-frame; track aligning jack means for moving the sub-frame laterally of the main frame; and track lifting jack means connected to each of the guide members to move each member, with its hook, vertically of the sub-frame to adjust the vertical position of said hook relative to said sub-frame and to lift said track.

According to a preferred feature of the invention vertically extending guide-rod means are provided on the sub-frame to constrain each guide member for vertical movement on the sub-frame.

According to a second preferred feature of the invention each guide member may include guide-rail means extending within the guide member transversely of the main frame to constrain each hook for adjustment longitudinally of the sub-frame.

According to yet another preferred feature of the invention means is provided for adjusting and positioning at least one of the rail contacting means to accommodate changes in rail spacing.

The present invention also provides a railroad track lifting aligning device mounted for track travel on a longitudinally extending main frame of a track working machine and comprising a track aligning sub-frame extending transversely of and beneath the main frame; wheels on the sub-frame for engaging the rails of the track to support the sub-frame on the track; rail contacting means, one adjacent each end of the sub-frame for engaging the inside of each of the rails of the track; a track lifting rail hook guide member for each of the rails of the track mounted for vertical movement on the sub-frame at each end thereof on vertically extending guide-rod means on the sub-frame; a rail hook for externally engaging a rail of the track mounted within each guide member on guide rods extending transversely of the main frame; means connected on the one hand to a guide member and on the other hand to the sub-frame for adjusting the position of the rail hook longitudinally of the sub-frame; track aligning means connected on the one hand to the main frame and on the other hand to the sub-frame for moving the sub-frame laterally of the main frame to transversely align the track; and track lifting jack means connected on the one hand to the main frame and on the other hand to a guide member to move each guide member with its hook vertically of the sub-frame to adjust the position of said hook vertically of said sub-frame and to lift the track.

Preferably at least one contacting means is movably mounted on the sub-frame and biasing means, on the sub-frame, is positioned to urge the rail contacting means longitudinally outwardly of the sub-frame.

The following is a description, by way of example, of an embodiment of the invention reference being had to the accompanying drawings in which:

FIG. 1 is a diagramatic illustration, in elevation, of a production and switch tamping machine incorporating a lifting and aligning apparatus; and FIG. 2 is a detail to an enlarged scale looking generally in the direction of the arrows II—II in FIG. 1 and with the left hand side of the drawing in cross-section.

DESCRIPTION OF THE PREFERRED EMBODIMENT

Figure 1:
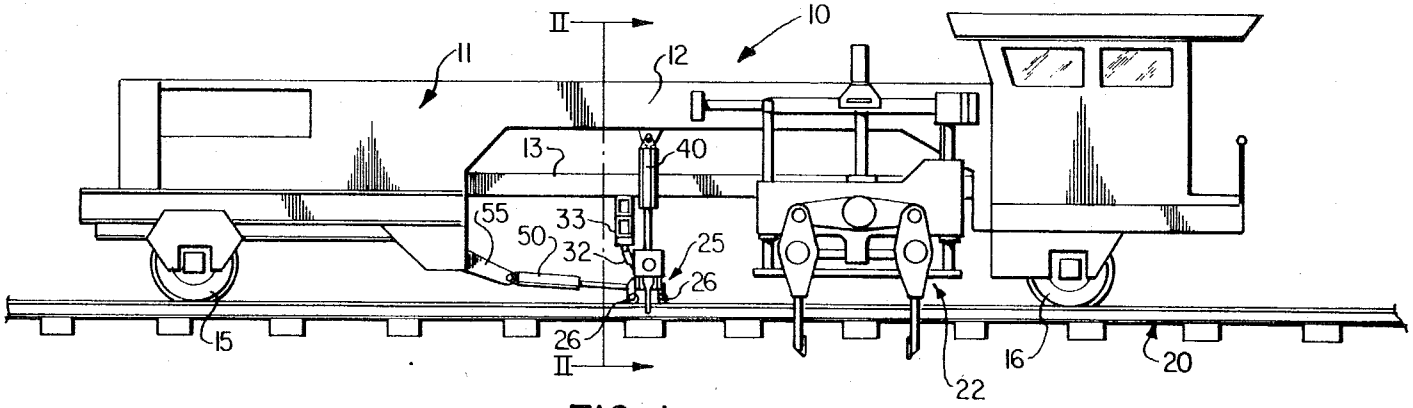
Figure 2:
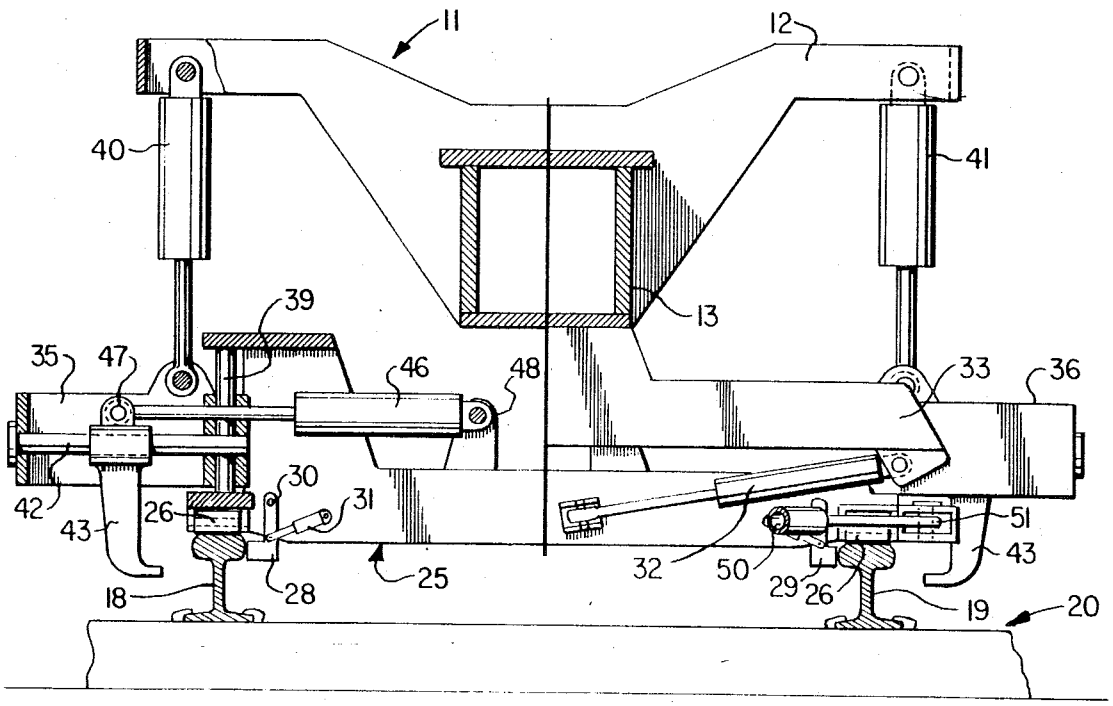

Referring now to the drawings, a tamping machine 10 has a longitudinally extending main frame 11 generally of T cross-section, having an upper part 12 and a central box girder 13 (FIG. 2). The rail engaging wheels 15 and 16 by which the tamping machine 10 is supported and propelled on the rails 18, 19 of the track 20 are totally conventional and need no description here. The tamping head, generally indicated at 22, is also of well known type and again requires no description here. Mounted beneath the main frame 11 and extending transversely of that frame is a sub-frame 25. The sub-frame is mounted on flangeless rollers or wheels 26 which, in operation, sit on the heads of the rails 18 and 19 and support the weight of the sub-frame 25. Mounted on the sub-frame 25 are rail contacting members 28, 29 at least one 28 of which is suitably moveable laterally on the sub-frame and, in the embodiment shown, is pivoted on the sub-frame 25 at 30 and biased by means of hydraulic piston and cylinder arrangement 31 into contact with the inside of the rail head 18. The other rail contacting member 29 may be similarly pivoted and biased or may conveniently simply be fixed to the sub-frame 25. The movement of the member 28 accommodates for differences in rail guage, for example due to rail wear. A pair of aligning jacks 32 (only one of which is seen in FIG. 2 because the left hand side of that Figure is in section) are pivotally connected between the sub-frame 25 and a transverse extension 33 from the box girder 13 of the main frame. By pushing and pulling with the jacks 32, the sub-frame 25 is caused to act as a track aligning frame, the forces from the jacks 32 being transmitted through the rail contacting members 28, 29 to move the track to the left, or right, as desired.

At the outer ends of the sub-frame 25 (best seen to the left on FIG. 2) are a pair of track lifting rail hook guide members 35, 36. These members 35 and 36 are mounted for vertical sliding motion on vertically extending guide rods 39 on the sub-frame 25. Only one of the guide rods 39 is shown but it will be understood that they may be provided in pairs one behind the other for each of the members 35, 36.

Pivotally connected to the members 35, 36 and to the T portion 12 of the main frame 11 are a pair of track lifting jacks 40 and 41. These jacks act to raise and lower the guide members 35, 36 on the guide rods 39, vertically relative to the sub-frame 25.

Within each guide member 35, 36 is a horizontally extending guide-rail 42 and slidingly mounted on the guide-rail 42 is a rail engaging hook 43. Each rail hook may be adjusted towards and away from the outsides of the rails by means of piston and cylinder arrangements 46 connected on the one hand to the hook 43 at 47, and on the other hand to the sub-frame 25, at 48.

The sub-frame 25 together with the guide members 35, 36 and the hooks 43 may be skewed, as is usual with devices of this nature, by means of piston and cylinder arrangements 50 pivotally connected to the sub-frame 25 at 51, externally of the wheels 26 and to an extension 55 on the main frame 11.

In operation the sub-frame sits on the rails 18, 19 and the rail contacting elements 28, 29 are moved into position against the inside of the rail heads, the cylinders 46 are contracted to bring the hooks 43 into engagement with the underside of the rail heads, the vertical position of the hooks 43 being adjusted by jacks 40 and 41 for the largest rail head size expected to be encountered (thus taking care of the smaller rail head if such is encountered). The track is lifted by the cylinders 40, 41 and aligned by the cylinders 32 in accordance with command signals received from a reference system, as is well known in the art. When a switch is encountered one of the hooks 43 is extended or retracted on its guide-rail 42 by its cylinder 46 to accommodate for the difference in rail position in the switch.

Because the lifting operation is conducted separately of the aligning frame 25, that is to say since the hooks 43 with their guide members 35, 36 move relatively vertically to the sub-frame 25, if a rail hook 43 slips off a rail head, the position of the track aligning sub-frame with its rail contacting elements 28, 29 is not disturbed, this allows for speedy repositioning of the rail hooks 43 and consequently a high rate of production. Also, since the track aligning sub-frame 25 sits on the track and is not disturbed if the rail hooks 43 slip from the rail heads, the members 28, 29 are not damaged during the lining operation because they have not been moved out of contact with the inside of the rail heads and the aligning operation is performed consistently and accurately.

Hook 43 movement, in high production operations, can be limited by limit, or proximity, switches in order to rapidly position the hooks 43 in switches, such proximity or limit switches being arranged to be readily overridden.

It will also be understood that, if desired, the dimensions of the hooks 43 and the guide rods 39 could be such that the hooks 43 could be arranged to engage the underside of the rail rather than the underside of the ball of the rail or portions of joint bars or other parts of the rail structure.

What I claim as our invention is:

1. A railroad track lifting and aligning device mounted for track travel on a longitudinally extending main frame of a track working machine and comprising a track aligning sub-frame extending transversely of said main frame; wheels on said sub-frame for engaging the rails of the track; rail contacting means on said sub-frame for engaging the inside of each of the rails of the track; vertically extending guide-rod means on said sub-frame; a track lifting rail hook guide member for each of the rails of the track mounted for vertical movement on and relative to, said sub-frame at each end thereof on said vertically extending guide-rod means on said sub-frame; a rail hook, for externally engaging a rail of the track, in each of said guide members; means for adjusting the position of a rail hook in its guide member, longitudinally of said sub-frame; track aligning jack means for moving said sub-frame laterally of said main frame; and track lifting jack means connected to each of said guide members to move each member, with its hook, vertically of said sub-frame along said guide-rod means to adjust the vertical position of said hook relative to said sub-frame and to lift said track vertically.

2. A device as claimed in claim 1 in which each guide member includes guide-rail means extending within said guide member transversely of said main frame, to constrain each hook for adjustment longitudinally of said sub-frame.

3. A device as claimed in claim 2 in which means is provided for adjusting and positioning at least one of said rail contacting means to accommodate changes in rail spacing.

4. A device as claimed in claim 1 or claim 3 in which means is provided for adjusting and positioning at least one of said rail contacting means to accommodate changes in rail spacing.

5. A device as claimed in claim 1 in which each guide member includes guide-rail means extending within said guide member transversely of said main frame, to constrain each hook for adjustment longitudinally of said sub-frame.

6. A device as claimed in claim 5 in which means is provided for adjusting and positioning at least one of said rail contacting means to accommodate changes in rail spacing.

7. A device as claimed in claim 1 in which means is provided for adjusting and positioning at least one of said rail contacting means to accommodate changes in rail spacing.

8. A railroad track lifting and aligning device mounted for track travel on a longitudinally extending main frame of a track working machine and comprising a track aligning sub-frame extending transversely of and beneath said main frame; wheels on said sub-frame for engaging the rails of the track to support said sub-frame on said track; rail contacting means, one adjacent each end of the sub-frame for engaging the inside of each of the rails of the track; vertically extending guide-rod means on said sub-frame; a track lifting rail hook guide member for each of the rails of the track mounted for vertical movement on and relative to, the sub-frame at each end thereof on said vertically extending guide-rod means on said sub-frame; a rail hook for externally engaging a rail of the track mounted within each guide member on guide-rail means extending transversely of the main frame; means connected on the one hand to a rail hook and on the other hand to the sub-frame for adjusting the position of the rail hook on its guide-rail means longitudinally of said sub-frame; track aligning jack means connected on the one hand to the main frame and on the other hand to the sub-frame for moving said sub-frame laterally on said main frame to transversely align the track; and track lifting jack means connected on the one hand to said main frame and on the other hand to said track lifting rail hook guide members to move each said guide member with its hook vertically of said sub-frame along said guide-rod means to adjust the position of said hook vertically of said sub-frame and to lift said track vertically.

9. A device as claimed in claim 8 in which at least one of said rail contacting means is movably mounted on said sub-frame and biasing means, on said sub-frame, is positioned to urge said rail contacting means longitudinally outwardly of said sub-frame.

* * * * *